United States Patent [19]

Akai et al.

[11] 3,971,393

[45] July 27, 1976

[54] APPARATUS FOR AUTOMATIC SUPPLEMENT OF CHANGE COINS IN A COIN OPERATED MACHINE

[75] Inventors: Kazuyuki Akai, Sakato; Osamu Kobayashi, Saitama, both of Japan

[73] Assignee: Kabushiki Kaisha Nippon Koinko, Tokyo, Japan

[22] Filed: Oct. 10, 1974

[21] Appl. No.: 513,946

[30] Foreign Application Priority Data

| | | |
|---|---|---|
| Oct. 12, 1973 | Japan | 48-113850 |
| Nov. 14, 1973 | Japan | 48-130737 |
| Apr. 23, 1974 | Japan | 49-45100 |
| Apr. 23, 1974 | Japan | 49-45101 |
| Apr. 23, 1974 | Japan | 49-45102 |

[52] U.S. Cl. ..... 133/2

[51] Int. Cl.[2] ..... G07D 9/06

[58] Field of Search ..... 133/2; 221/10, 177, 221/93, 95, 197, 281, 287, 125, 11, 121, 122; 194/10

[56] References Cited

UNITED STATES PATENTS

| | | | |
|---|---|---|---|
| 2,489,765 | 11/1949 | Emerson et al. | 221/93 X |
| 2,778,368 | 1/1957 | Jaskowiak | 133/2 |
| 2,881,774 | 4/1959 | Labbe | 133/2 |
| 3,010,556 | 11/1961 | Wawrzonek et al. | 221/125 X |

*Primary Examiner*—Stanley H. Tollberg
*Attorney, Agent, or Firm*—Haseltine, Lake & Waters

[57] ABSTRACT

Apparatus for automatic feed of change coins in a coin operated machine comprising a storage section for change coins including a cylinder for the change coins, a discharge section for discharging coins stored in the cylinder into a guide section which in turn supplies the coins to a second cylinder in which the coins are stored for distribution as change when instructed by a coin selection control device. Such control device includes a drive motor which operates the discharge section under the control of a switch which is operated when the coins in the second cylinder reach a pre-determined minimum amount.

10 Claims, 21 Drawing Figures

APPARATUS FOR AUTOMATIC SUPPLEMENT OF CHANGE COINS IN A COIN OPERATED MACHINE

FIELD OF THE INVENTION

This invention relates to an apparatus for automatic supplement of change coins in a coin operated machine.

BACKGROUND

Coin operated machines are known which generally comprise a selecting mechanism section for coins put therein, an integration counting mechanism section for the coins selected by the selecting mechanism section, a section for automatically supplying into a change coin cylinder small denomination coins (nickels or dimes, for instance), which are to be used as change, among the selected coins, and a change paying mechanism section for counting out suitable change from the change coin cylinder according to the instructions of the integration counting mechanism section.

Currently, nickels, dimes and quarters are circulating in large quantities, and the frequency of payment of change is extremely high, so that if change coins are supplemented only by the input coins, there is the disadvantage that they may not be present in sufficient quantity for payment of change and a condition of shortage of the change coins arises whereby the machine can no longer accept larger denomination coins requiring change. As a result thereof, during the time in which the change coins are not supplemented, the machine cannot be used and thus is extremely reduced in its time of operation.

SUMMARY OF THE INVENTION

An object of this invention is to provide an apparatus for automatic supplement of change coins for eliminating the foregoing deficiencies.

Another object of the invention is to provide such apparatus in which the automatic supplement of change coins is smoothly effected.

An additional object of the invention is to lengthen the life of a control circuit of a driving section of the machine.

According to the invention, there is provided an apparatus for automatic supplement of change coins in a coin operated machine comprising a change coin storage section including a change coin containing cylinder, discharging means operatively coupled with said coin storing section for discharging coins stored in the change coin storing section, guide means for receiving coins discharged from the discharging means section and for advancably guiding the coins, a coin selection control device including a change coin cylinder for receiving the coins from said guide means, and switch means operable upon detection of a shortage of coins in the change coin cylinder, and a drive means for operating the discharging means to supply change coins to said change coin cylinder, said drive means being connected to said switch means for being operated thereby.

According to a feature of the invention, said discharging means comprises a chute for discharging the coins stored in the change coin storing section one by one.

According to a further feature of the invention, said drive means includes a motor which is operated for a predetermined period of time by closure of said switch means in response to a change coin shortage signal from the coin selection control device.

It is additionally contemplated according to the invention that said discharging means comprises a plurality of juxtaposed plates including fixed plates and rotatable plates driven by said drive means. Said plates have holes therein which are successively brought into alignment with one another to transfer the change coins from one plate to another and thence to said guide means.

According to another feature of the invention, the change coin storing section includes a frame, and means are provided pivotably supporting said frame for movement between a first position in which said change coin containing cylinder is exposed for refilling and a second position in which said cylinder is concealed.

DETAILED DESCRIPTION

Figure 1:
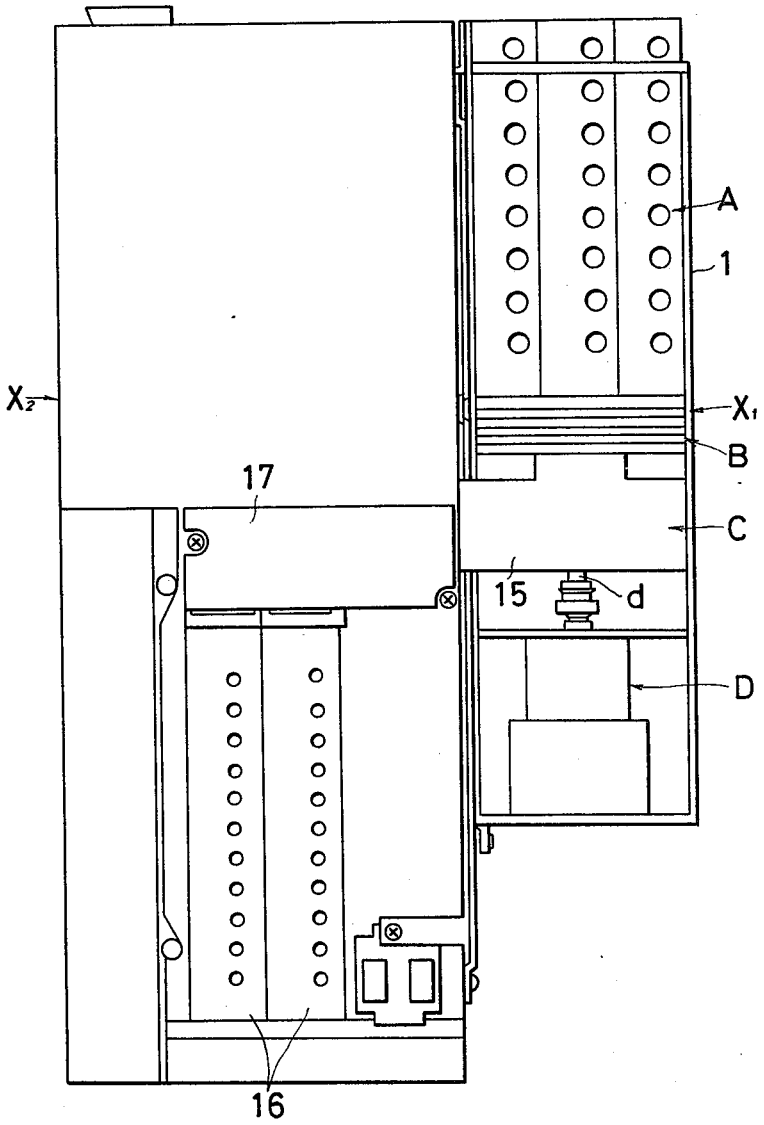
FIG. 1 is a diagrammatic elevational view of a coin operated machine according to the invention.

This invention contemplates apparatus $X_1$ including, as shown is FIG. 1, a change coin storing section A having a change coin containing cylinder, a discharging mechanism section B for discharging the necessary number of coins from the coins stored in the change coin storing section A, a guide section C for receiving the coins discharged from the discharging mechanism section B and leading these to a change coin cylinder provided in a coin selection control apparatus $X_2$ and a driving section D for operating the discharging mechanism section B. The sections are mounted in a frame member 1 which is elongated in a vertical direction.

Figure 2:
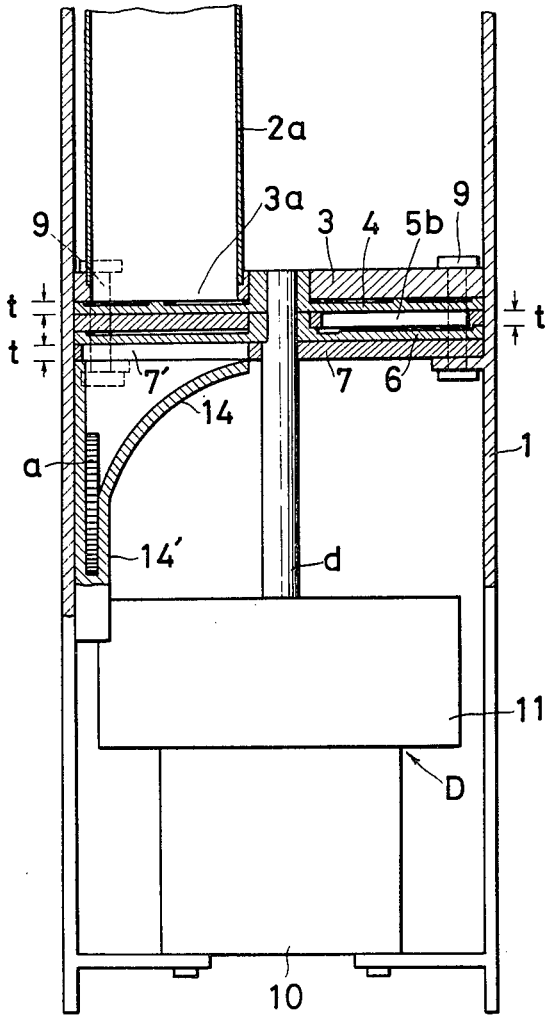
FIG. 2 is a sectional view taken through the machine of FIG. 1 including a discharging mechanism section.
Figure 3:
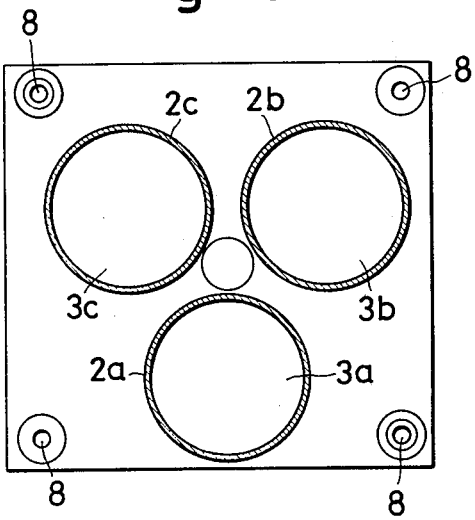
FIG. 3 is a top plan view of an upper stationary plate of the discharging mechanism.

The change coin storing section A is provided with a plurality (three in the illustrated example) of change coin containing cylinders 2*a* – 2*c*. As shown in FIGS. 2 and 3, these cylinders are vertically supported at regular intervals (120° each), on a circle on a stationary plate 3 attached horizontally to the frame member 1, and the stationary plate 3 is provided with openings 3*a* – 3*c* which are in communication with the change coin containing cylinders 2*a* – 2*c*.

Figure 4:
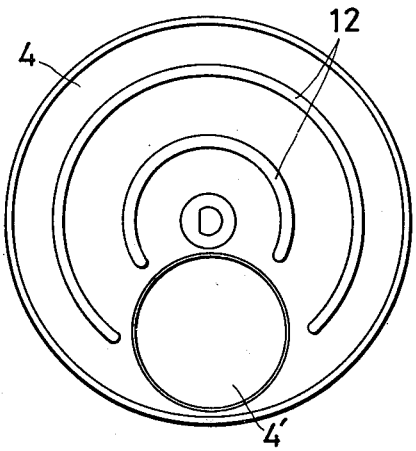
FIG. 4 is a top plan view of an upper rotary plate thereof.
Figure 5:
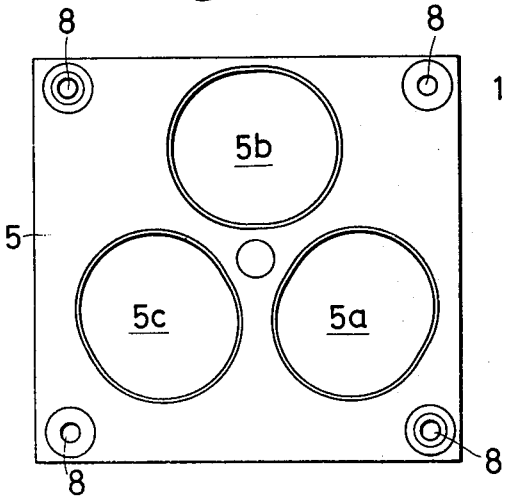
FIG. 5 is a top plan view of an intermediate stationary plate thereof, FIGS. 6*a* and *b* are respectively a top plan view of a lower rotary plate thereof and an enlarged sectional view thereof taken along lines I — I in FIG. 6*a*.
Figure 6:
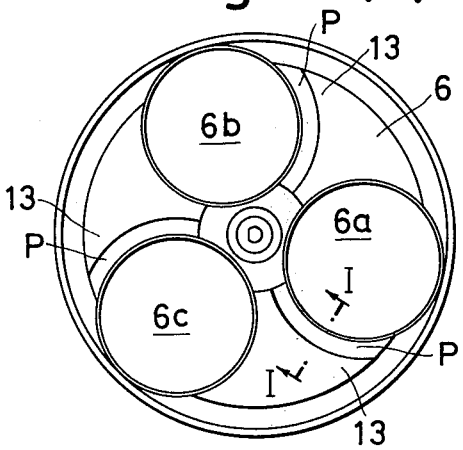
Figure 6:
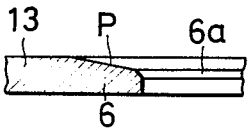
Figure 7:
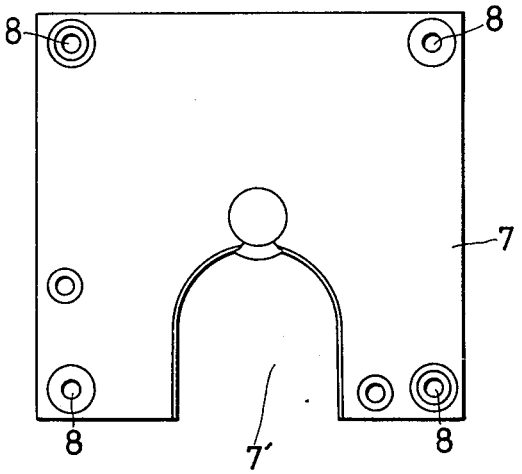
FIG. 7 is a top plan view of a lower stationary plate thereof.

The discharging mechanism section B comprises the foregoing stationary plate 3, a rotary plate 4 having, as shown in FIG. 4, a single opening 4′ which is to be selectively in coincidence with any of the foregoing openings 3*a* – 3*c*, a stationary plate 5, as shown in FIG. 5, having three openings 5*a* – 5*c* which are disposed on a common circle at regular intervals (120°) so as to be selectively in coincidence with the foregoing opening 4′, a rotary plate 6, as shown in FIGS. 6*a* and *b*, having three openings 6*a* – 6*c* which are disposed on a common circle at regular intervals (120°) so as to be respectively in coincidence with the foregoing three openings 5*a* – 5*c*, and a stationary plate 7, as shown in FIG. 7, having a single discharge opening 7′ arranged to be in coincidence with any one of the openings 6*a* – 6*c*.

These five plates are juxtaposed one upon the other in such a manner that, as shown in FIG. 2, the rotary plate 4 is beneath the stationary plate 3, the stationary plate 5 is beneath rotary plate 4 so that the openings 5*a* – 5*c* have a respective angular displacement of 60° in relation to the foregoing openings 3*a* – 3*c*, the rotary plate 6 is beneath the stationary plate 5 and the stationary plate 7 is beneath plate 6 so that the discharge opening 7′ is not in coincidence with any of the openings 5*a* – 5*c*. The stationary plates 3,5,7 are attached to the frame member 1 by securing means 9 through attaching holes 8 at the four corners of each plate, and the rotary plates 4 and 6 are attached to a driving shaft *d* of the driving section D comprising a driving motor 10 and a speed-reduction mechanism 11.

The above-mentioned openings 4′, 5*a* – 5*c* and 6*a* – 6*c* each has a depth suitable for receiving a single coin, and the rotary plate 4 is provided on its upper surface with a rib 12 for minimizing frictional resistance thereof with the stationary plate 3. The rotary plate 6 has sections 13 between the openings which are formed with a slightly inclined surface P at the upper face along the circumferential edge of each of the openings 6*a* – 6*c*.

Figure 8A:
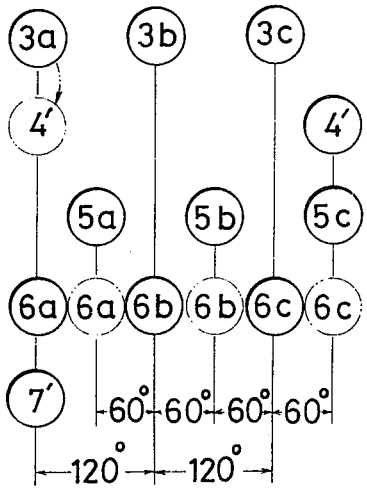
FIGS. 8*a* – 8*g* are diagrammatic explanatory views of the operation of the discharging mechanism section.
Figure 8B:
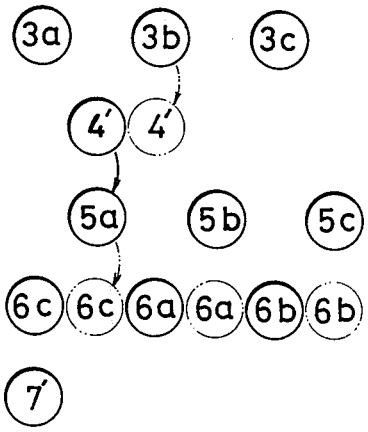
Figure 8C:
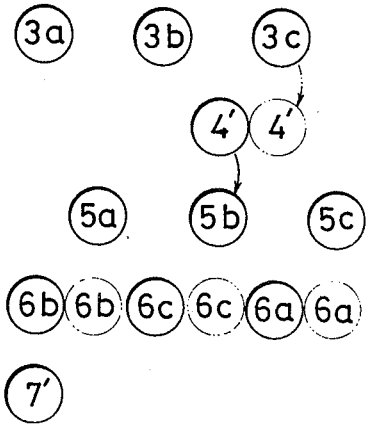
Figure 8:
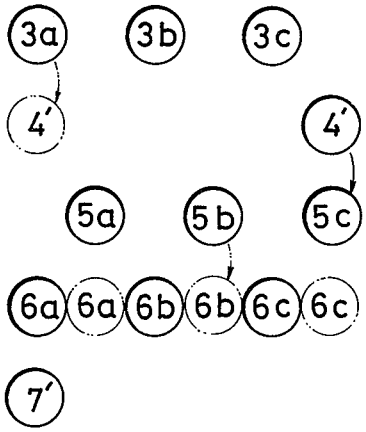
Figure 8:
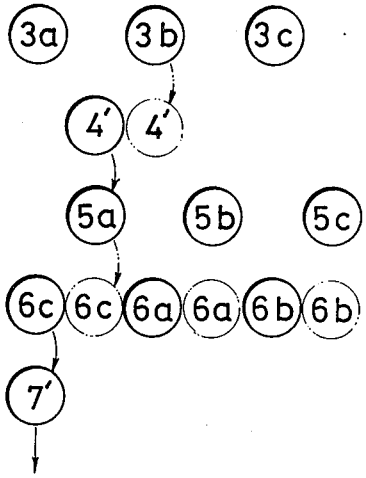
Figure 8:
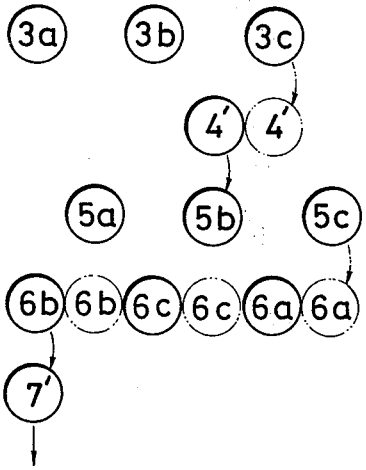
Figure 8:
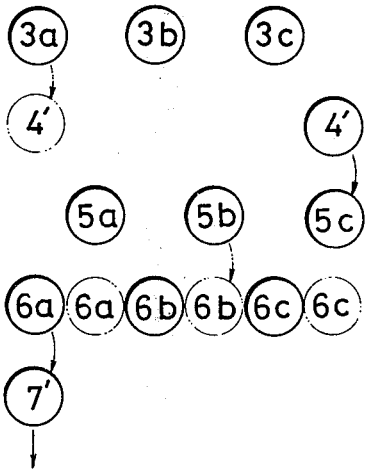

The discharging mechanism section B thus constituted by the five plates 3 – 7 operates as follows:

If it is now assumed that starting from the condition shown in solid lines in FIG. 8*a* the driving shaft *d* makes a 60° rotation to reach the condition shown by the phantom lines in the same Figure, the opening 4′ comes into coincidence with the opening 3*a* and the opening 4′ receives one of the coins in the change coin containing cylinder 2*a*. If, then, the driving shaft *d* makes a further 60° rotation, the condition shown in solid lines in FIG. 8*b* results so that the coin within the opening 4′ is transferred to the opening 5*a*, and by the next 60° rotation the opening 4′ coincides with the opening 3*b* as shown by the phantom lines in the FIG. 8*b* and receives one of the coins within the change coin containing cylinder 2*b* while at the same time the coin within the opening 5*a* is transferred to the opening 6*c*. If, next, the driving shaft *d* makes a further 60° rotation, there is brought about the condition shown in solid lines in FIG. 8*c*, and the coin within the opening 4′ is transferred to the opening 5*b*, and by the next 60° rotation the opening 4′ coincides with the opening 3*c* as shown by phantom lines in FIG. 8*c* and receives one of the coins in the change coin cylinder 2*c*. Though, in this case, the openings 5*b* and 6*c* are in coincidence with one another, the coin within the opening 5*b* does not transfer to the opening 6*c* because a coin is already present in the opening 6*c*. If, next, the driving shaft makes a 60° rotation, there is brought about the condition shown in solid lines in FIG. 8*d* and the coin within the opening 4′ is transferred to the opening 5*c* and by the next 60° rotation the opening 4′ coincides with the opening 3*a* as shown by phantom lines in FIG. 8*d* and receives one of the coins in the change coin containing cylinder 2*a* and at the same time the coin within the opening 5*b* is transferred to the opening 6*b*. Though, in this case, the openings 5*c* and 6*c* coincide with each other, the coin within the opening 5*c* is not transferred to the opening 6*c* because a coin is already present in the opening 6*c*. When, next, the driving shaft *d* makes a 60° rotation and thereby there is brought about the condition shown in FIG. 8*e*, the coin of the first order within the opening 6*c* is discharged from the discharge opening 7′ and the coin within the opening 4′ is transferred to the opening 5*a*, and by the next 60° rotation the opening 4′ receives a single coin from the opening 3*b* and the coin within the opening 5*a* is transferred to the opening 6*c*, and if, then, the driving shaft *d* makes a 60° rotation, the coin of the second order within the opening 6*b* is discharged from the discharge opening 7′ as shown by solid lines in FIG. 8*f*, and the coin within the opening 4′ is transferred to the opening 5*b* and by the next 60° rotation the opening 4′ receives a single coin from the opening 3*c* as shown by phantom lines in FIG. 8*f*, and the coin within the opening 5*c* is transferred to the opening 6*a*. If, next, the driving shaft *d* makes a 60° rotation, the coin of the third order within the opening 6*a* is discharged from the discharge opening 7′ as shown by solid lines in FIG. 8*g*, and the coin within the opening 4′ is transferred to the opening 5*c* and by the next 60° rotation the opening 4′ receives a single coin from the opening 3*a* as shown by phantom lines in FIG. 8*g* and the coin within the opening 5*b* is transferred to the opening 6*b*.

Thus, it is carried out that during one rotation of the drive shaft *d*, one coin from each of the respective change coin containing cylinders 2*a* – 2*c* is received in order through the openings 3*a* – 3*c* by the opening 4′ and these are transferred in order to the openings 6*a* – 6*c* through the three openings 5*a* – 5*c*, and further the coins, three coins in total, transferred to the openings 6*a* – 6*c* are discharged one by one from the discharge opening 7′ at every rotation of the driving shaft *d*.

The above is the case where three change coin containing cylinders are provided, but when two or more than four change coin containing cylinders are provided, the number of openings corresponds to the number of cylinders and are made at regular intervals in each of the stationary plates 3,5 and the rotary plate 6.

The guide section C comprises, as shown in FIG. 2, a funnel shape portion 14 for receiving the coin discharged from the discharge opening 7′ and for turning the coin so that at the lower portion of the funnel, the coin is in an upright position as shown. A guide trough 15 is connected to the lower part 14′ for guiding the coin in its upright position.

The coin selection controlling apparatus $X_2$ on which the apparatus $X_1$ of the invention is mounted, comprises, as is well known, a selecting mechanism section for coins introduced therein, an integration counting mechanism section for counting the coins selected by the selecting mechanism section, a mechanism section for automatically supplying change coin cylinders 16 with small denomination coins, which are to be used as change coins, among the selected coins and a change paying mechanism for delivering change coins from the change coin cylinders 16, according to instructions of the integration counting mechanism section.

The coin selection controlling apparatus $X_2$ is provided with a second trough 17 for receiving the incoming coins from the guide trough 15 and supplying the coins into the change coin cylinders 16. At the terminal end of trough 17 there is provided, in a known manner, a distributing section 18 for automatically distributing the coins into the two change coin cylinders 16.

Figure 9:
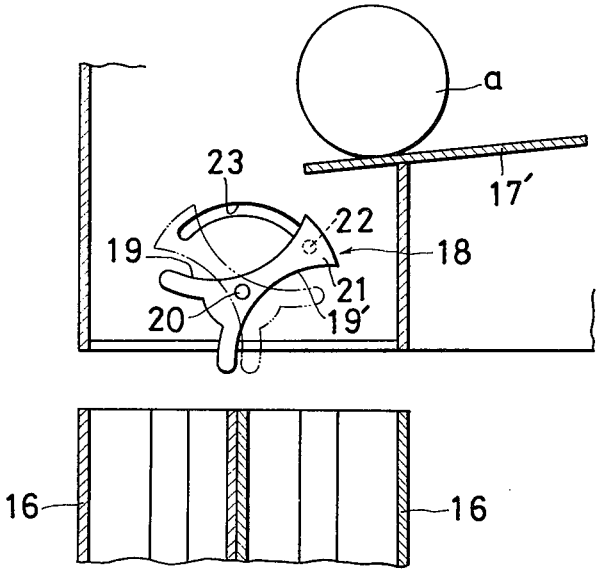
FIG. 9 is a detail in partial section of a coin distributing section.

The distributing section 18 comprises, as shown in in FIG. 9, a member 21 having right and left curved surfaces 19 and 19' and a center portion swingably pivoted at 20 within the guide trough 17. This member 21 is always kept inclined by a weight 22 either to the right or the left and when the incoming coin *a*, while rolling in a passage 17', falls onto one of the curved surfaces 19 and 19' the member 21 turns to incline within the range of the guide groove 23. Namely, at each time of descent of a coin, the conditions shown by the solid lines and the phantom lines in FIG. 9 are repeated alternately and thereby the coins are distributed and supplied alternately into the change coin cylinders 16.

Figure 11:
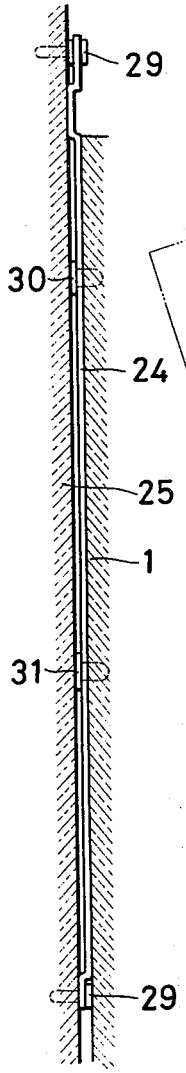
FIG. 11 is a sectional view showing the attached condition of the coin selection controlling apparatus and the coin storage and discharging mechanism of this invention.
Figure 10:
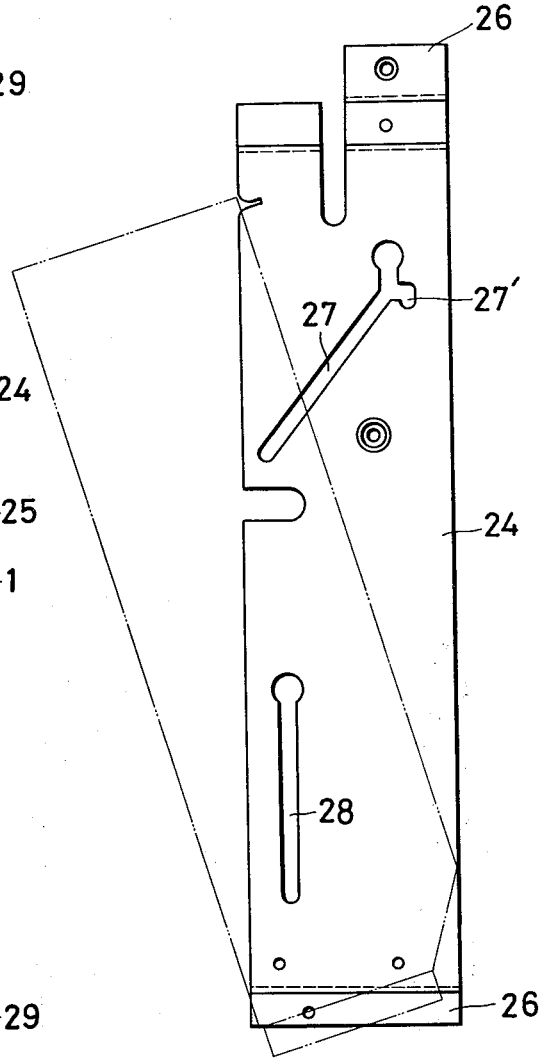
FIG. 10 is a front view of an attaching subsidiary plate.

The apparatus $X_1$ is detachably attached to a side wall 25 of the coin selection controlling apparatus $X_2$ through an attaching subsidiary plate 24. As shown in FIG. 10, the subsidiary plate 24 is an elongated plate having attaching sections 26 at its upper and lower portions and a wider middle portion. An oblique slit 27 and a vertical slit 28 are made in upper and lower parts of the middle portion, and the plate is attached by fixing screws 29 to the side wall 25 of the coin selection controlling apparatus $X_2$ as shown in FIG. 11. The side surface of the frame member 1 of apparatus $X_1$ is provided with projecting axial pins with heads 30,31 to be engaged with the slits 27,28 respectively, and the apparatus $X_1$ is usually attached in a suspended condition by engagement of the upper axial pin 30 with a step portion 27' at the upper end of the upper slit 27. If the axial pin 30, from this condition, is lowered along the slit 27 obliquely, the other axial pin 31 is also lowered vertically along the slit 28, and when both the axial pins 30,31 reach the lower ends of the slits 27,28 the apparatus $X_1$ is inclined at a position lowered by the length of the slit 28 in relation to the attaching subsidiary plate 24 as shown in the phantom lines in FIG. 10. Accordingly, the introduction of change coins into the change coin containing cylinders 2*a* – 2*c* can be easily carried out.

Figure 12:
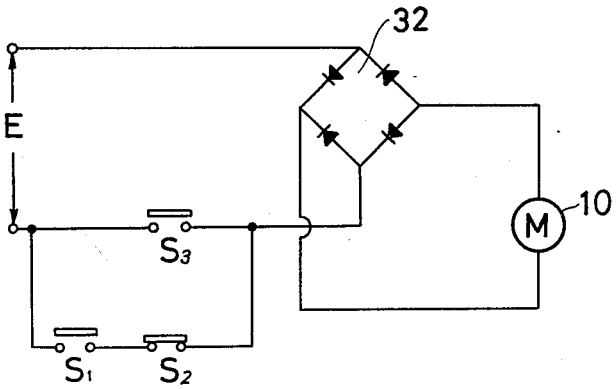
FIG. 12 is a schematic diagram of a control circuit for a motor.

A control circuit of the driving section D is constructed as shown in FIG. 12. Therein, electric motor 10 is connected to one pair of opposite connecting terminals of a full wave rectification circuit 32 constituted by four diodes connected to form a bridge, and a power source E is connected to the other pair of opposite connecting terminals thereof. This power circuit is further provided with an ordinarily open carrier switch $S_3$ which becomes ON when the motor 10 has started and becomes OFF when the motor 10 has rotated the foregoing rotary plates 4,6 by an amount corresponding to one rotation, for instance, by using a cam. The switch $S_3$ is connected in parallel to a series circuit of an ordinarily open change coin shortage detecting switch $S_1$ which becomes ON when coins for change within the change coin cylinders 16 are diminished to a predetermined extent and an ordinarily closed change short detection switch $S_2$ which becomes OFF when coins for change in the change coin containing cylinders 2*a* – 2*c* are diminished to a predetermined extent. Such switches are well known in the art and the form of their control is entirely conventional and outside the scope of the invention. Such control can be by photoelectric means, weight detection of the coins in the cylinders, etc.

Thus, in the condition in which coins for change are sufficiently stored in the change coin containing cylinders 2*a* – 2*c*, when coins for change in the change cylinders 16, become short, the switch $S_1$ is closed to drive the motor 10. And when supplement of change coins from the change coin storing section A into the change coin cylinders 16, has been made, the switch $S_1$ opens but since the switch $S_3$ is maintained on its ON condition by starting of the motor 10, the rotation of the motor 10 is continued by the switch $S_3$ until the rotary plates 4,6 each makes one rotation, so that coins are supplied into the change coin cylinders 16, from the change coin storing section A.

Figure 13:
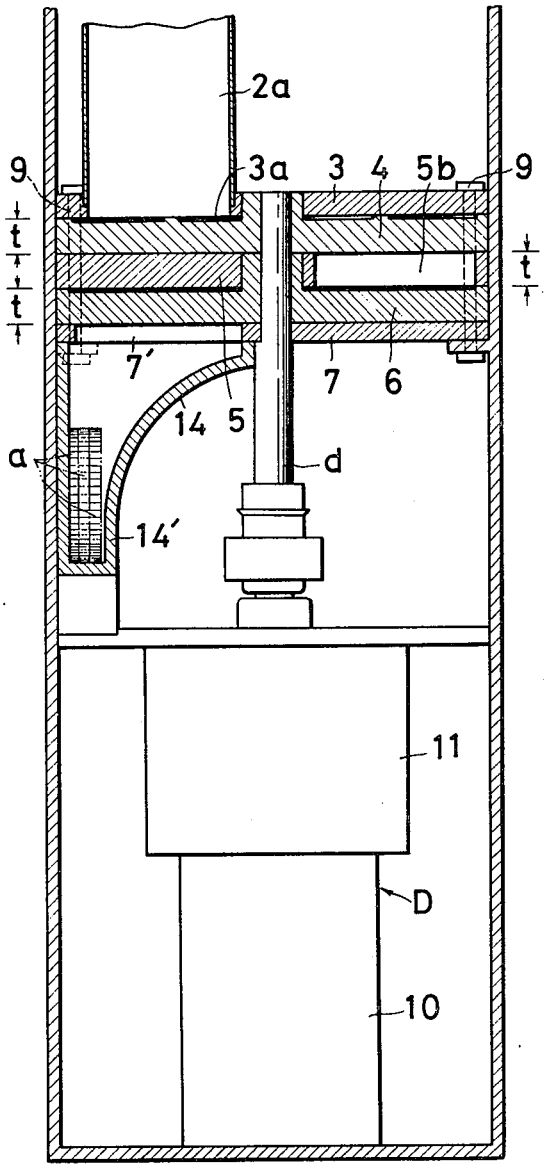
FIG. 13 is a sectional view of a detail portion including the discharging mechanism section according to another embodiment.

The foregoing example refers to the case in which the depth *t* of each of the openings 4', 5*a* – 5*c* and 6*a* – 6*c* is suitable for receiving a single coin and coins are discharged one by one in order from the discharging mechanism section B. However, if, as shown in FIG. 13, the depth *t* of each of the openings 4', 5*a* – 5*c* and 6*a* – 6*c* is one having an integral number of times the thickness of a single coin, two of more than two coins can be discharged simultaneously from the discharging mechanism section B and in this case the lower portion 14' of the funnel shape section 14 has such a width that a plurality of coins can be mounted therein in their uprightly stacked condition.

Figure 14:
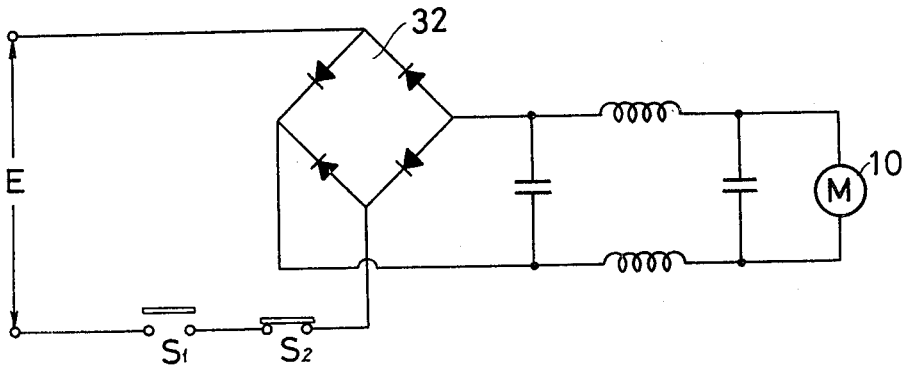
FIG. 14 is a schematic diagram of a control circuit for a motor according to another embodiment.

Though FIG. 12 shows the control circuit of the driving section D in the case when the rotary plates 4, 6 are driven in rotation by using the carrier switch $S_3$, FIG. 14 shows a control circuit of the driving section D which is so constructed that the driving of the driving section D may be controlled by the change coin shortage detecting switch provided in the coin selection controlling apparatus. Namely, electric motor 10 is connected to one pair of opposite connecting terminals of a full wave rectification circuit 32 constituted by four diodes connected to form a bridge, and a power source E is connected to the other pair of opposite connecting terminals thereof. Connected in series in the power cource circuit are ordinarily open change coin shortage detecting switch $S_1$ which becomes ON when coins for change within the change coin cylinders 16, become short and ordinarily closed change coin shortage detecting switch $S_2$ which becomes OFF when coins for change within the change coin containing cylinders 5*a* – 5*c* become short.

Thus, in the condition in which coins for change are stored sufficiently within the change coin containing cylinders 2*a* – 2*c*, when coins for change within the change coin cylinders 16, become short, the switch $S_1$ is closed to drive the motor 10, and when the switch $S_1$ is restored to OFF by supply of coins from the change coin storing section D into the change coin cylinders 16, the rotation of the motor 10 stops. Namely, during the time that the switch $S_1$ is closed, the motor 10 rotates to supply coins into the change coin cylinders 16.

As clear from the above description, this invention is so constituted that, in the change coin cylinder provided in the coin selection controlling apparatus, the driving section is operated by utilizing the switch which operates when coins contained in the change coin cylinder become short (hitherto, this switch has been to actuate a sales stop mechanism) and thereby the discharging mechanism section is operated so as to discharge coins within the change coin storing section and delivering the same automatically to the coin selection controlling apparatus. Therefore, such disadvantage that the machine is not operated due to a shortage of change coins as in the conventional machine can be prevented and the operation can be assured. Further, by the provision of the discharging mechanism section in which coins within the change coin storing section may be discharged one by one, there can be eliminated such disadvantage that, as in the case of simply discharging a plurality of coins, such coins drop together into the guide portion and as a result the coins can block the guide portion and prevent feed of the coins. Further, when it is so arranged that the driving section is operated at a predetermined period of time by a change coin shortage signal from the coin selection controlling apparatus, a large number of coins can be supplied to the change coin cylinder together and an advantage can be brought about that the change coin shortage detecting switch is not opened and closed frequently and the life of the electric circuit can be lengthened.

What is claimed is:

1. An apparatus for automatic supplement of change coins in a coin operated machine having a coin selection control device including a change coin cylinder and a switch means, said apparatus being detachably connected to said coin selection control device and comprising a change coin storing section including a change coin containing cylinder, discharging means operatively coupled with said coin storing section for discharging coins stored in the change coin storing section, guide means for receiving coins discharged from the discharging means and for guiding the coins to the change coin cylinder of the coin selection control device and means connected to said switch means so as to be operated thereby upon detection of a shortage of coins in the change coin cylinder by the switch means, for operating the discharging means to supply change coins to said change coin cylinder.

2. Apparatus as claimed in claim 1, wherein said discharging means comprises a chute for discharging the coins stored in the change coin storing section one by one.

3. Apparatus as claimed in claim 1, wherein the drive means includes a motor which is operated for a predetermined period of time by closure of said switch means in response to a change coin shortage signal from the coin selection control device.

4. Apparatus as claimed in claim 3, wherein said discharging means comprises a chute for discharging the coins stored in the change coin storing section one by one.

5. Apparatus as claimed in claim 1, wherein said discharging means comprises a plurality of juxtaposed plates including fixed plates and rotatable plates driven by said drive means.

6. Apparatus as claimed in claim 5, wherein said plates have holes therein which are successively brought into alignment with one another to transfer the change coins from one plate to another and thence to said guide means.

7. Apparatus as claimed in claim 1 wherein said selection control device includes a plurality of change coin cylinders, said apparatus further comprising a distribution means for distributing the coins from said guide means alternately to said change coin cylinders of the selection control device.

8. Apparatus as claimed in claim 1, comprising an attaching subsidiary plate and a pivotally supporting pin by which the apparatus is detachably attached to the coin selection control device such that the apparatus can be inclined in relation to the coin selection control device to move between a first position in which said change coin containing cylinder is exposed for refilling and a second position in which said cylinder is concealed.

9. Apparatus as claimed in claim 1, wherein a plurality of said change coin containing cylinders are provided.

10. Apparatus as claimed in claim 9, wherein said guide means includes a chute constructed to convey a plurality of coins at one time from the change coin containing cylinders of the coin storing section to the change coin cylinder of the coin selection control device.

* * * * *